US008494412B2

(12) United States Patent
Moore et al.

(10) Patent No.: US 8,494,412 B2
(45) Date of Patent: Jul. 23, 2013

(54) VACUUM DRIVE FOR WEB CONTROL AT PHOTORECEPTOR

(75) Inventors: Kenneth Paul Moore, Rochester, NY (US); Frank Albert Porter, Penfield, NY (US); Bruce Allen Thompson, Fairport, NY (US); Todd Maurice Uthman, Rochester, NY (US); Ron Edward Dufort, Rochester, NY (US); Venkata Bharadwaj Chivukula, Webster, NY (US); Roger Gaylord Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 294 days.

(21) Appl. No.: 13/073,403

(22) Filed: Mar. 28, 2011

(65) Prior Publication Data

US 2012/0251148 A1 Oct. 4, 2012

(51) Int. Cl.
*G03G 15/08* (2006.01)

(52) U.S. Cl.
USPC ..... 399/121; 399/66

(58) Field of Classification Search
USPC ..... 399/66, 121, 297
See application file for complete search history.

(56) References Cited

U.S. PATENT DOCUMENTS

| | | | | | |
|---|---|---|---|---|---|
| 3,630,591 | A * | 12/1971 | Eastman | 399/398 |
| 4,144,550 | A * | 3/1979 | Donohue et al. | 399/77 |
| 4,169,673 | A * | 10/1979 | Sato et al. | 399/317 |
| 5,860,053 | A | 1/1999 | Stemmle | |
| 5,875,383 | A | 2/1999 | Stemmle | |
| 5,878,320 | A | 3/1999 | Stemmle | |
| 5,970,304 | A | 10/1999 | Stemmle | |
| 6,369,842 | B1 | 4/2002 | Abramsohn | |
| 6,909,516 | B1 | 6/2005 | Hoover | |
| 7,379,680 | B2 * | 5/2008 | Calamita | 399/36 |
| 7,444,101 | B2 * | 10/2008 | Calamita | 399/167 |
| 2006/0244404 | A1 * | 11/2006 | Carolan | 318/432 |
| 2006/0257158 | A1 * | 11/2006 | Calamita | 399/36 |
| 2008/0089703 | A1 * | 4/2008 | Calamita | 399/36 |
| 2009/0304424 | A1 * | 12/2009 | Walsh | 399/361 |
| 2012/0308286 | A1 * | 12/2012 | Porter et al. | 399/384 |

* cited by examiner

*Primary Examiner* — G. M. Hyder
(74) *Attorney, Agent, or Firm* — Fay Sharpe LLP

(57) ABSTRACT

Systems and a method for image forming systems to skip over the non-printing photoreceptor area in order to not skip a label position on a continuous print web medium. A vacuum assembly is coupled to a controller that controls different vacuum pressures at each vacuum roller therein. The vacuum rollers provide drag and drive forces to skip a seam of the photoreceptor and a residual length based on the number and size of images on the photoreceptor.

20 Claims, 3 Drawing Sheets

VACUUM DRIVE FOR WEB CONTROL AT PHOTORECEPTOR

BACKGROUND

The subject embodiment pertains to the art of printing systems. More particularly, this disclosure relates to a system and method for synchronizing relative operating positions of photoreceptor belts within the printing assembly to avoid undesirable belt seam positioning that can diminish system throughput efficiency.

Electrophotography, a method of copying or printing documents, is performed by exposing a light image representation of a desired original image onto a substantially uniformly charged photoreceptor substrate, such as a photoreceptor belt. In response to this light image, the photoreceptor discharges to create an electrostatic latent image of the desired original image on the photoreceptor's surface. Developing material, or toner, is then deposited onto the latent image to form a developed image. The developed image is then transferred to an image receiving substrate. The surface of the photoreceptor is then cleaned to remove residual developing material and the surface as recharged by a charging device in preparation for the production of the next image.

For example, FIG. 1 schematically depicts the various components of one electro photographic printing/imaging system 10 for printing images on a continuous print web medium 12 or cut sheet substrate with the same print device. A similar system is shown, for example, in U.S. Pat. No. 6,909,516, U.S. Pat. No. 6,369,842, U.S. Pat. No. 5,970,304, U.S. Pat. No. 5,878,320, U.S. Pat. No. 5,875,383, U.S. Pat. No. 5,860,053, which are incorporated herein by reference in their entirety.

As shown schematically with dashed line outlines, a printer or imaging device 14 may optionally include a document sheet feeding and scanning module 15 and/or an integral/separate electronics input and/or network server module, as on the left side of printer 14. In this exemplary printer or print engine 14, a conventional single continuous belt photoreceptor 16 having a seam 16*a* is being sequentially imaged with latent images, such as by a ROS laser printing charging station 18, or an LED bar, or the like. Although not illustrated in detail, the seam 16*a* has a width and length, which may be different in dimension than illustrated in FIG. 1 depending upon the system, belt and/or construction. The latent images on the photoreceptor belt 16 are developed with visible image developer material (e.g., toner) by a development station 20, which may include multiple development units for multiple colors. At an image transfer station 22 the developed images are transferred from the photoreceptor 16 to one side of the image substrate or print web medium. In this particular example, the transfer station 22 is located near the downstream side of the printer 14, where the photoreceptor belt 16 is moving vertically upward.

Within the xerographic print engine 14, a conventional fusing station system 23 is provided, in which transferred developed images are permanently affixed or fused to the continuous print web medium 12 when the system 10 is in a continuous print web mode and to a cut-sheet print medium when in a cut-sheet mode. A fusing assembly of the fusing station 23 permanently affixes the transferred powder or toner, for example, via a heated fuser roller and a back-up roller with the powder image contacting the fuser roller. The printer 14 is controlled by a programmable controller 11 that can operate the scanning module 15, a web feed module 70 and/or a finisher module (not shown).

The web feed module 70 is provided for turning over the web 12 after one side 12*a* has been imaged at a first side, and fused in a first roll fuser 80, then returning the inverted web 12 in proper page sequence for its opposite, second, side 12*b* printing, in which additional transfer stations to the transfer station 22 having a transfer module 72*a* may be used. The web 12 path illustrated in FIG. 1 includes multiple rollers, such as a ninety degree web turn roller 78 to turn the web vertically into a first side web expandable loop 79 formed by an outer, first, 180 degree web turn roller 81, and a first side moving roll fuser 80, as well as other rollers for angling, transposing, and moving the web 12 up into a second side roll fuser 90, for example, for duplex printing.

Printing engines utilizing photoreceptor belts, as opposed to drums, have seams where two ends of the belt are fastened together to make an endless surface. Consequently, the seam prevents uninterrupted continuous imaging of the photoreceptor. Wasted resources, such as unused web (e.g., portions of a paper roll or other medium) often result from the seam. In addition, if used to store any image data, the seam can mar the output image or provide non-uniformity, particularly with continuous feed web input and output. Continuous web feed systems are well suited for disengaging the web from the photoreceptor belt, reversing web direction, reversing again, and re-engaging the web to synchronize with the photoreceptor belt, which is known as a "pilgrim step." It is an operational objective that there is no delay in paper feed through such imaging systems so that throughput is consistently maximized.

INCORPORATION BY REFERENCE

The following references, the disclosures of which are incorporated in their entireties by reference, are mentioned:

U.S. Pat. No. 6,909,516, by Martin E. Hoover, entitled: "TWO DIMENSIONAL SURFACE MOTION SENSING SYSTEM USING REGISTRATION MARKS AND LINEAR ARRAY SENSOR," issued Jun. 21, 2005, is totally incorporated herein in its entirety.

U.S. Pat. No. 6,369,842, by Denis A. Abramsohn, entitled: "PERMANENT PHOTORECEPTOR REGISTRATION MARKING AND METHOD," issued Apr. 9, 2002, is totally incorporated herein in its entirety.

U.S. Pat. No. 5,970,304, by Denis J. Stemmle, entitled: "TWO SIDED IMAGING OF A CONTINUOUS WEB SUBSTRATE WITH A SINGLE PRINT ENGINE WITH IN LINE TRANSFER STATIONS," issued Oct. 19, 1999, is totally incorporated herein in its entirety.

U.S. Pat. No. 5,878,320, by Denis J. Stemmle, entitled: "CONTINUOUS IMAGING OF A CONTINUOUS WEB SUBSTRATE WITH A SINGLE PRINT ENGINE WITH A PHOTORECEPTOR BELT SEAM," issued Mar. 2, 1999, is totally incorporated herein in its entirety.

U.S. Pat. No. 5,875,383, by Denis J. Stemmle, entitled: "DUAL MODE INTERCHANGEABLE MODULES CUT SHEET OR WEB PRINTING SYSTEM WITH A SINGLE XEROGRAPHIC CUT SHEET PRINT ENGINE," issued Feb. 23, 1999, is totally incorporated herein in its entirety.

U.S. Pat. No. 5,860,053, by Denis J. Stemmle, entitled: "TWO SIDED IMAGING OF A CONTINUOUS WEB SUBSTRATE WITH A SINGLE PRINT ENGINE WITH ALTERNATING TRANSFER STATIONS," issued Jan. 12, 1999, is totally incorporated herein in its entirety.

BRIEF DESCRIPTION

Various aspects of the present invention are now summarized to facilitate a basic understanding of the invention, wherein this summary is not an extensive overview of the invention, and is intended neither to identify certain elements of the invention, nor to delineate the scope thereof. Rather, the primary purpose of this summary is to present some concepts of the invention in a simplified form prior to the more detailed description that is presented hereinafter.

Methods and systems are disclosed that operate a print medium to skip the photoreceptor belt seam length of a photoreceptor plus a residual length resulting from a number of labels that fit on the belt and an inter document zone (IDZ) between each labels for a print job. For example, a vacuum roller assembly is adapted to break a transfer nip at a transfer location in order to skip the seam of the photoreceptor and the residual length, which extends from the seam to the next image thereon. The vacuum roller assembly operates one or more vacuum rollers to first retract or disengage the print medium from the photoreceptor, reverse direction to drive the print medium backwards, and then reverse back again to re-synchronize the print medium back with the photoreceptor belt to the next full image after the seam for continuous and uniform imaging operations. A controller storing a control algorithm responds in a dynamic way to data obtained from the print job and the photoreceptor to control the uniformity of the image transfer onto the print medium by skipping over the seam for continuous and uniform print webs.

In one embodiment, an image forming device has a photoreceptor, a charging device that generates electrical charge to the photoreceptor, an exposure station that patterns an exposure on the photoreceptor, and a development station to develop toner onto the photoreceptor. The device has a transfer station at a transfer location proximate to the photoreceptor that is configured to transfer toner from the photoreceptor to a printing medium with a transfer current. A controller determines the different tension forces and durations to apply them to a continuous print web medium by signaling a change in vacuums of the vacuum assembly based on print data received at each print job, the print seam area, and an inter-document zone (IDZ).

In another embodiment, a method controls a continuous print web at a photoreceptor of an imaging system. The method comprises providing a first vacuum signal to a vacuum assembly for a first vacuum roller and second vacuum signal for a second vacuum roller of the assembly to alter vacuum pressure within each. A transfer nip at the transfer station and the photoreceptor belt is broken by disengaging print web medium with the vacuum assembly rollers. The vacuum pressure within each roller is varied to maintain web tension with pressure gauges or the like. While one roller provides a drive force, the other roller provides a drag force based on a first vacuum pressure and a second vacuum pressure respectively therein. The vacuum rollers operate to first retract or disengage the print medium from the photoreceptor, reverse direction to drive the print medium backwards, and then reverse back again to re-synchronize the continuous print web while skipping over a non-print photoreceptor distance, a residual distance and a distance of the IDZ.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description when considered in conjunction with the drawings, in which.

DETAILED DESCRIPTION

Figure 1:
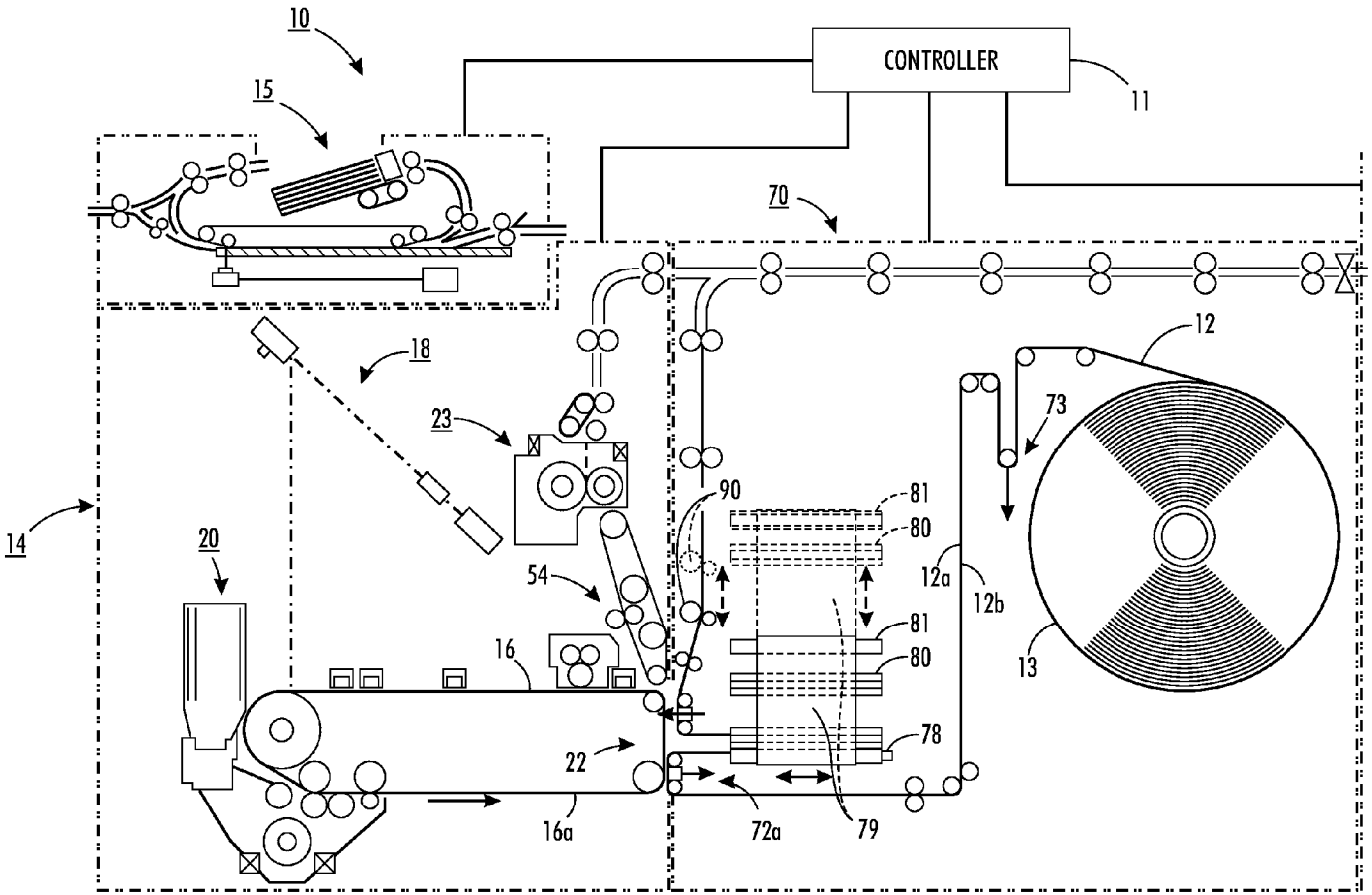
FIG. 1 PRIOR ART
FIG. 1 is a schematic representation of an exemplary image forming system according to prior art.

Referring now to the figures, several embodiments or implementations are hereinafter described in conjunction with the drawings, wherein like reference numerals are used to refer to like elements throughout, and wherein the various features are not necessarily drawn to scale.

Figure 2:
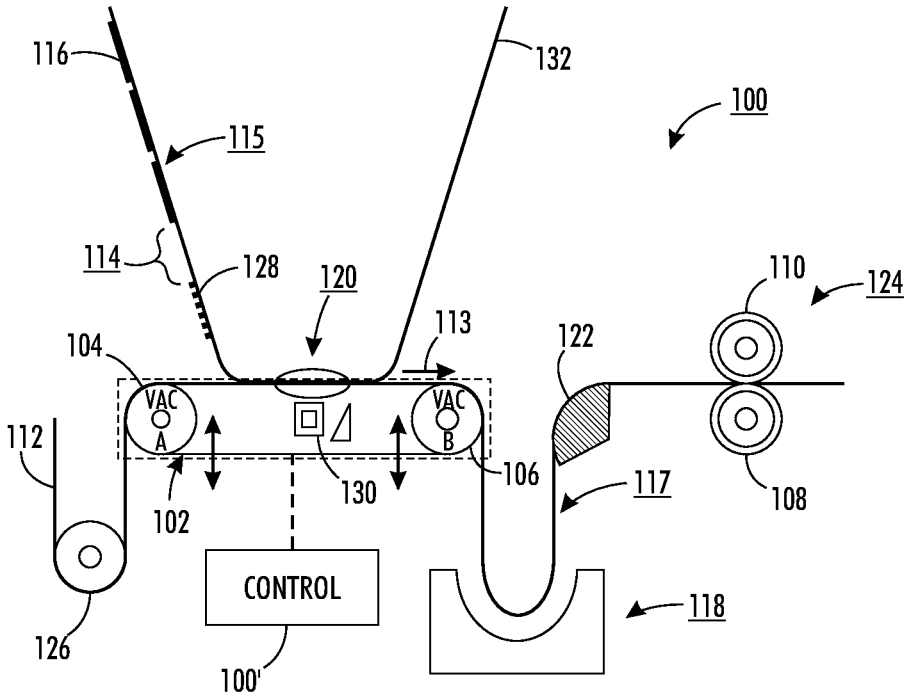
FIG. 2 is a schematic representation according to an exemplary aspect of the present disclosure.

Referring to FIG. 2, is illustrated an exemplary aspect of the present disclosure of an image forming device 100 having a vacuum assembly 102 that includes a first vacuum roll 104 (VAC A) and a second vacuum roll 106 (VAC B). A photoreceptor belt 132 of the image forming device 100 creates a transfer nip 120 at a transfer location where an electrostatic connection is formed.

The first vacuum roller 104 and second vacuum roller 106 are located proximate to the transfer station 130 having a transfer nip 120 with the photoreceptor 132 where images are transferred with a current to the continuous print web medium 112. The transfer station 130 can comprise a corotron or scorotron, a dicorotron and transfer blade, a bias transfer roll (BTR) or like transfer technology that is located behind the web 112. The first vacuum roll 104 and the second vacuum roll 106 are used in the vacuum assembly 102 to disengage the web 112 from the transfer nip (e.g., an electrostatic connection) at the photoreceptor, such as by vertically moving the rollers 104, 106, together with the web 112 and transfer station 130 away from the photoreceptor. Depending upon the width or other dimensions of the images or labels for any particular job request, the vacuum rolls 104, 106 move the web in a forward and/or a reverse direction to skip over the length of the photoreceptor seam area (a non-printable area) while taking into account the position of the next image on the photoreceptor for transfer. This may include accounting for a revolution speed of the photoreceptor. The vacuum rolls 104, 106, for example, drive the web at a percentage faster or slower, or the same as that of the photoreceptor surface revolving, in order to re-synchronize or re-engage the web 112 with the photoreceptor belt 132 for continuing uniformity of the images. Because the dimensions of the images or labels being transferred can change, so can the distance or residual length that is accounted for when re-engaging the web 112 to the photoreceptor 132 for each print job on the web 112. The controller 101 signals the first and the second vacuum rolls 104, 106 to change speed, direction, and/or displacement in order to provide uniformity in the inter document zone between the images transferred onto the web and seamless imaging.

The controller 101 is configured to dynamically control tension forces provided to the print web 112 by the vacuum assembly 102. Where the photoreceptor 132 is a seamed web belt, with a belt ends fastening seam such as 128, the vacuum rolls 104 and 106 of the assembly 102 briefly disengage the web 112 away from the photoreceptor 132 for the passage of the non-imaged area around that belt seam to avoid a wasted unprinted or blank space on the web every time that portion of the photoreceptor belt comes around (every photoreceptor revolution). The first and second vacuum rolls 104, 106 provide an integral web loop coordinate in the assembly 102 with a temporary interruption in the downstream web feeding, so that, as a web accumulation loop 117 is retracted and then expanded (as the web is removed from and then returned to engagement with the photoreceptor), the web 112 does not advance between its removal and return within the seam area and no unprinted area wastage occurs. The web may also be effectively reversed back to the end of the prior transferred image area in the web transfer loop. The next image can thus be printed onto the web 112 following the previous image thereon even though the photoreceptor 132 has a substantial gap between its images for the non-imaged photoreceptor belt section or seam area of seam 128.

Control signals from the controller 101 cause a change in plenum pressure via a gauge (not shown) at the first and second vacuum rollers 104, 106. The first vacuum roller 104 therefore has a first vacuum pressure therein and the second vacuum roller 106 has a second vacuum pressure that may vary according to the first roller, or vice versa, the first may vary according to the second roller. The vacuum assembly 102 is configured to break the transfer nip 120 and move the print web medium 112 away from the photoreceptor a certain distance, for example, and control the operation of a "pilgrim step" to seamlessly skip over the seam 128 during each print job at each revolution of the photoreceptor 132 and any remainder portion needed to re-align the web with the belt for re-engagement.

In one embodiment, the controller 101 determines or calculates the number of images that can be transferred from the photoreceptor belt 132 to the print medium per revolution of the belt, in addition to a residual length that is a distance extending laterally along the photoreceptor belt and the print web 112 from the seam 128 to the next image thereon. For example, the controller 101 receives the label size and number of labels for each print job. Then, based on the print job data it receives, the controller 101 calculates a residual length that includes the seam length and the distance between the seam 128 and the next image label on the photoreceptor 132. The controller 101 provides signals to cause the vacuum assembly 102 with the vacuum rollers 104, and 106 to separate the web 112 from the transfer nip at each revolution of the photoreceptor 132 and provide tension forces with each vacuum roll to move the web 112 the distance determined to re-engage the web 112 at a proper location, time, and distance for consistent image uniformity. The residual length, the seam length, and the inter document zone (IDZ) length between each image is therefore dynamically determined to control uniformity in spacing between image labels on the continuous print web medium for each print job.

A toner powder image 116 developed on the photoreceptor belt contacts the advancing print web 112 with transfer station 130, for example, a bias transfer roll or a dicot with a transfer blade that provides for electrostatic and mechanical image transfer. After transfer, the web 112 continues to move in the direction of arrow 113 with the vacuum assembly 102, which advances the sheet to fusing station 124. The fuser and pressure rollers 108 and 110 at the fusing station 124 move at a substantially constant velocity and pressure to fuse the transferred images onto the web 112. A vacuum drag shoe 122 provides a constant vacuum drag force to provide a constant tension force on the web medium 112 for the fuser and pressure rollers.

In certain embodiments, the vacuum drag shoe 122, the first vacuum roll 104 and the second vacuum roll 106 have variable vacuum plenum pressures respectively for adjusting web tension forces on the web 112. For example, the controller 101 provides signals to vary the vacuum pressure at the vacuum drag shoe 122, the first vacuum roll 104 and/or the second vacuum roll 106 with gauges thereat or by other like mechanisms, such as a strain gauge in a servo loop drive to vary plenum pressure thereat. The first vacuum roll 104 and the second vacuum roll 106 are used for forward and/or reverse drive directions with the take up roll 126.

For example, at each revolution of the photoreceptor belt 132 images 116 are formed thereon to be transferred at the transfer station 130 (e.g., a dicorotron with a transfer blade for mechanical compressing, or the like). The photoreceptor belt revolves in a counter rotation relevant to the revolution of the print web 112. The belt 132 has a defined distance along its perimeter and is able to have a fixed number of images 116 depending upon their size and shape thereon together with the seam area 128. As discussed above, when receiving a print job, the controller 101 determines the image space allowable based on the distance between each image (i.e., the interdocument zone 115, at approximately three millimeters, for example, between images), the image area or width, the seam area 128 and a residual length 114 that results from the number of labels that fit on the belt 132. The controller 101 signals the vacuum assembly 102 having the first vacuum roller 104 and second vacuum roller 106 to break or disengage the transfer nip 120 connection and separate, vertically or otherwise, with the web 112 and transfer station 130. Then, the vacuum rollers 104 and 106 change vacuum pressure therein to reverse a certain distance, which corresponds to an amount of web in an accumulation region or loop 117 that has collected or held in an accumulator plenum 118 or channel for collecting the loop 117. The vacuum assembly 102 provides different tension forces to the web 112 using different vacuum pressures at the vacuum rollers for driving the web 112 in reverse once it is disengaged then for moving forward in order to re-engage the transfer nip 120. In certain embodiments, the fuser and pressure rollers 108 and 110 rotate at a slower velocity than the photoreceptor belt 132 and web 112 in order to maintain the accumulation loop 117.

An advantage of having different vacuum rollers 104 and 106 driving the web is that top surface forces along the web are avoided to not disturb the unfused image during web reversing. For example, the first vacuum roller 104 (VAC A) and the second vacuum roller 106 (VAC B) have different vacuum pressures for any given duration to increase control and provide drive and drag forces corresponding to each other and the direction of web movement. When the transfer nip 120 is engaged and images are being transferred to the web 112, the second vacuum roller 106 (VAC B) provides web drive force using a maximum vacuum or a vacuum that is greater than the vacuum of the first vacuum roller 104 (VAC A). Concurrently, the first vacuum roller 104 comprises a lower vacuum pressure, and thus, provides a drag force to maintain a desired web tension. A lower or minimum vacuum (e.g., a first vacuum) of the first vacuum roller 104 provides tension to the web through a drag force in order to further prevent slip and reduce criticality of speed matching the two vacuum rolls 104 and 106, which vary from one another in proportion to the force each provides to the web 112.

Further, when the transfer nip 120 is disengaged, the vacuum assembly 102 reverses the web to enable a skip of the seam area or length 128 and the residual length 114. The reversed web is approximate to the amount of accumulated web in the accumulation loop 117 of the web 112, which is held by the plenum 118. During reverse movement of the web 112, the first and second vacuum rollers 104, 106 of the assembly 102, alter their respective vacuum pressures according to the control signals received so that each has a vacuum pressure that is different from the other and substantially opposite of the vacuum pressures comprised during forward movement of the web 112. For example, the first vacuum roller 104 (VAC A) provides a reverse web drive force using a maximum vacuum or a first vacuum that is greater than a second vacuum of the second vacuum roller 106 (VAC B). While roll 104 provides a greater vacuum in a drive direction to reverse the web 112, the second vacuum roller 106 provides a drag force that aids to reverse the web 112 and also maintain web tension with a minimum or lower vacuum therein. Afterwards, the vacuum assembly engages and moves the web forward according to the control signals received to engage the web at the transfer nip 120 and synchronize or bring into line with the photoreceptor belt at a location that skips over the non-printable area (seam area) plus the residual length 114 for uniform label images to be transferred along the continuous web 112 seamlessly and uniformly.

Figure 3:
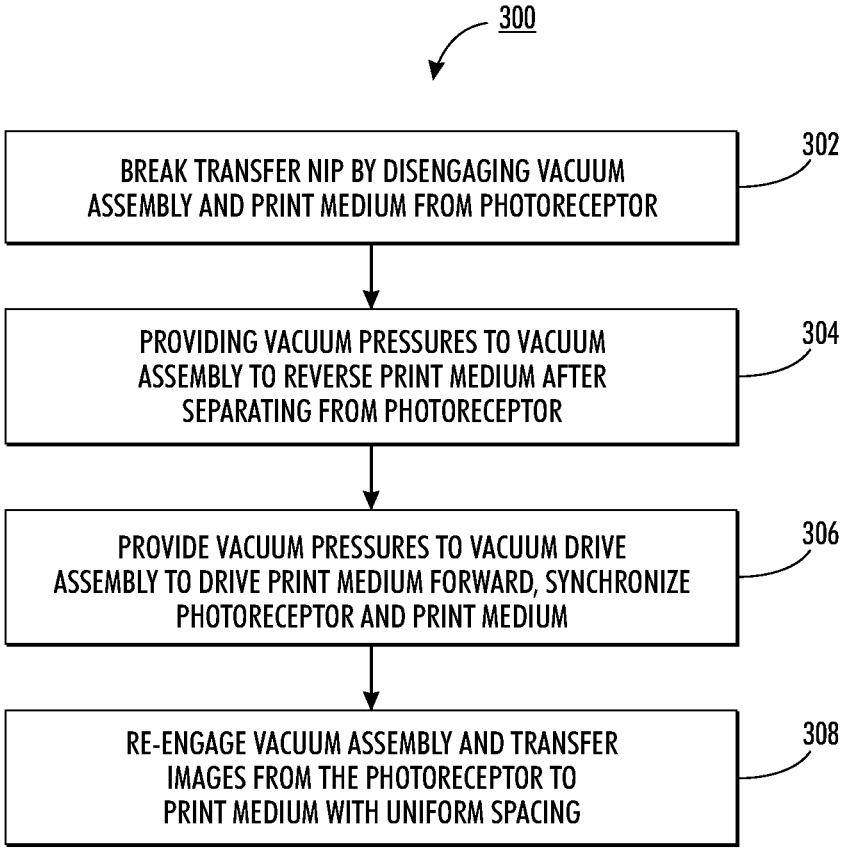
FIG. 3 is a flowchart detailing a process for controlling a web at a photoreceptor of an imaging system.

An example methodology 300 for controlling a web with a vacuum drive assembly at a photoreceptor of an image forming system is illustrated in FIG. 3 with references made to FIG. 2 to provide example for discussion. While the method 300 is illustrated and described below as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At step 302 in FIG. 3, a transfer nip 120 at a transfer location 72 along a photoreceptor 132 is broken by disengaging a vacuum drive assembly 102 and an image print medium 112 away from the photoreceptor. The vacuum drive assembly 102 provides tension forces, for example, both drag and drive forces concurrently for maintaining web tension and preventing slip.

At 304, vacuum pressures are provided to the vacuum drive assembly to reverse the image print medium in a reverse direction. For example, a first vacuum signal is provided by a controller 101 to the vacuum assembly 102 to cause a first vacuum roller 104 to generate a first vacuum, and a second vacuum signal is provided by the controller 101 to the assembly 106 for a second vacuum roller to generate a second different vacuum. The first vacuum is greater than the second vacuum to reverse the image print medium in the reverse direction.

At 306, vacuum pressures are provided to the vacuum drive assembly 102 to drive the print medium forward that is based on a distance and a rate to synchronize the medium (e.g., a continuous print web medium) with images on the photoreceptor while skipping over the seam area and residual 128, 114 or non-print photoreceptor distance, and an interdocument zone between the images on the photoreceptor while re-engaging and re-synchronizing the transfer nip. For example, a first vacuum signal is provided by a controller 101 to the vacuum assembly 102 to cause a first vacuum roller 104 to generate a first vacuum, and a second vacuum signal is provided by the controller 101 to the assembly 106 for a second vacuum roller to generate a second different vacuum. Here, the first vacuum is less than the second vacuum in the vacuum rollers of the assembly to drive the image print medium forward.

At 308, the vacuum assembly is re-engaged and images are transferred at the transfer station 130 from the photoreceptor 132 to the image print medium with a uniform spacing therebetween on a continuous print web medium 112.

The exemplary method may be implemented on one or more general purpose computers, special purpose computer (s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, or PAL, or the like. In general, any device, capable of implementing a finite state machine that is, in turn, capable of implementing the flowchart shown.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An image forming system, comprising:

a photoreceptor having a seam area;

a charging device that generates electrical charge to the photoreceptor;

an exposure station that patterns an exposure on the photoreceptor;

a development station that develops toner onto the photoreceptor;

a transfer station at a transfer location proximate to the photoreceptor that is configured to transfer toner from the photoreceptor to a continuous print web medium with a transfer current, or, a transfer current with a mechanical force;

a vacuum assembly located proximate the transfer location that is configured to engage and disengage the continuous print web medium with the photoreceptor at the transfer location and provide different tension forces thereto for driving the continuous print web medium in different directions; and a controller that determines the different tension forces and durations to apply them by signaling a change in vacuums of the vacuum assembly based on print data received at each print job, the print seam area of the photoreceptor and an interdocument zone.

2. The image forming system of claim 1, wherein the controller generates vacuum assembly signals to the vacuum assembly to vary different tension forces and durations for each print job based on the print data and apply the different tension forces and durations to the continuous print web medium at locations thereon where the seam area of the photoreceptor is adjacent to the transfer location.

3. The image forming system of claim 1, wherein the controller is configured to alter vacuum pressures of the vacuum assembly to provide the different tension forces including a drag and a drive force concurrently for forward and reverse motions to the continuous print web medium.

4. The image forming system of claim 1, wherein the vacuum assembly comprises a first vacuum roll located prior to the transfer location having a first vacuum;

a second vacuum roll located after the transfer location having a second vacuum that is different from the first vacuum, wherein the first vacuum roll and the second vacuum roll disengage the continuous print web medium at a first location of the photoreceptor to skip the seam area of the photoreceptor and re-engage the continuous print web medium at a second different location of the photoreceptor that is a distance equal to a length of the seam area plus the residual zone.

5. The image forming system of claim 1, comprising a vertical separator configured to disengage the continuous print web medium with the vacuum assembly at a first time from a transfer nip at the transfer location and re-engage the continuous print web medium at a second time based on a number of print labels, a size of each print label, the length of the seam area, and a rate in which the seam area encounters the continuous print web medium at each revolution of the photoreceptor without varying an area of the interdodument zone that includes area between each print label image transferred to the continuous print web medium.

6. The image forming system of claim 5, wherein the interdocument zone is approximately a uniform distance between each print label image transferred to the continuous print web medium for a print job.

7. The image forming system of claim 1, further comprising:

a fusing station that fuses toner to the continuous web print medium; and a vacuum drag shoe configured to maintain tension on the continuous web print medium prior to the fusing station.

8. An image forming system, comprising:

a photoreceptor belt with a non-printing photoreceptor area to transfer images onto a continuous print web medium;

a charging device that generates electrical charge to the photoreceptor belt;

an exposure station that patterns an exposure on the photoreceptor belt;

a development station that develops toner onto the photoreceptor belt;

a transfer station at a transfer location proximate to the photoreceptor that is configured to transfer toner from the photoreceptor to a continuous print web medium with a transfer current or a transfer current with a mechanical force;

a fusing station that fuses toner transferred onto the continuous print web medium;

a first vacuum roller having a first vacuum pressure and is located prior to the transfer location;

a second vacuum roller having a second vacuum pressure and is located after the transfer location; and wherein the first vacuum roller and the second vacuum roller are configured to engage and disengage the continuous print web medium with the photoreceptor at the transfer location by skipping a length along the photoreceptor belt during each revolution of the photoreceptor and providing the continuous print web medium synchronously to the photoreceptor belt at the transfer location with uniformly spaced interdocument zones between each toner image transferred thereat by the transfer station.

9. The image forming system of claim 8, further comprising:

a controller coupled to the first vacuum roller and the second vacuum roller that determines the first vacuum pressure and the second vacuum pressure based on print data received at each print job, at least one dimension of the non-printing photoreceptor area of the photoreceptor belt, at least one dimension of the interdocument zone.

10. The image forming system of claim 9, wherein the controller is configured to provide vacuum pressure signals to the first and the second vacuum roller to synchronize the photoreceptor belt with the transfer location by rotating the continuous print web medium in a counter direction with respect to the photoreceptor belt and concurrently skip over the non-printing photoreceptor area.

11. The image forming system of claim 9, further comprising:

an accumulator plenum for accumulating an accumulated region of the continuous web print medium prior to the fusing station;

a vacuum drag shoe that provides a drag force to the continuous web print medium prior to the fusing station and receives at least one vacuum pressure signal from the controller to set or vary the drag force based on a third vacuum pressure thereat.

12. The image forming system of claim 8, wherein the first vacuum pressure is less than the second vacuum pressure when the first and second roller move the continuous print web medium in a forward direction that is counter to rotation of the photoreceptor belt, and the first vacuum pressure is greater than the second vacuum pressure when the continuous print web medium is disengaged from the photoreceptor belt and the first and second roller move in a reverse direction that is a same direction as rotation of the photoreceptor belt.

13. The image forming system of claim 8, wherein the interdocument zone includes a length between each toner image transferred by the transfer station that is less than a length of the non-printing photoreceptor area.

14. The image forming system of claim 8, wherein the length includes a distance of the non-printing photoreceptor area, and a residual distance remaining that is based on a number of print labels for each print job onto the continuous print web medium.

15. A method for an image forming system having a vacuum drive assembly for web control at a photoreceptor, comprising:

breaking a transfer nip at a transfer location along the photoreceptor by disengaging the vacuum drive assembly and an image print medium away from the photoreceptor;

providing vacuum pressures to the vacuum drive assembly to reverse the image print medium in a reverse direction;

providing vacuum pressures to the vacuum drive assembly to drive forward the image print medium based on a distance and rate that synchronizes the image print medium with images on the photoreceptor while skipping over a non-print photoreceptor distance of a non-print photoreceptor area, and a residual distance between the images on the photoreceptor while re-engaging the transfer nip; and transferring images from the photoreceptor to the image print medium with a uniform spacing therebetween.

16. The method of claim 15, wherein providing vacuum signals to the vacuum drive assembly comprises:

providing a first vacuum signal to a first vacuum roller of the vacuum drive assembly to generate a first vacuum; and providing a second vacuum signal to a second vacuum roller of the vacuum drive assembly to generate a second different vacuum.

17. The method of claim 16, wherein the first vacuum is greater than the second vacuum to reverse the image print medium in the reverse direction, and the first vacuum is less than the second vacuum to drive the image print medium forward.

18. The method of claim 15, further comprising:

skipping over the residual distance based on a number of lengths of the images on the photoreceptor when re-engaging the transfer nip at the photoreceptor.

19. The method of claim 15, wherein breaking the transfer nip comprises:

disengaging the vacuum drive assembly and the image print medium in a vertical direction away from the photoreceptor, wherein the image print medium is a continuous print web that receives images transferred thereto from the photoreceptor with uniform spacing throughout each print job having multiple labels or images.

20. The method of claim 15, comprising:

fusing toner to the image print medium for images transferred thereon by a fusing station; and creating a drag force prior to the fusing station with a vacuum shoe having an adjustable plenum pressure for adjusting the drag force.

* * * * *